US011565220B2

(12) United States Patent
Ambrose

(10) Patent No.: US 11,565,220 B2
(45) Date of Patent: Jan. 31, 2023

(54) BOX WINE AERATION ACCESSORY

(71) Applicant: Dillon J Ambrose, Milwaukee, WI (US)

(72) Inventor: Dillon J Ambrose, Milwaukee, WI (US)

( * ) Notice: Subject to any disclaimer, the term of this patent is extended or adjusted under 35 U.S.C. 154(b) by 249 days.

(21) Appl. No.: 16/879,104

(22) Filed: May 20, 2020

(65) Prior Publication Data

US 2020/0384427 A1 Dec. 10, 2020

Related U.S. Application Data

(60) Provisional application No. 62/856,810, filed on Jun. 4, 2019.

(51) Int. Cl.

| | |
|---|---|
| ***B01F 23/23*** | (2022.01) |
| ***B01F 23/236*** | (2022.01) |
| ***B67D 7/06*** | (2010.01) |
| ***B67D 3/00*** | (2006.01) |
| ***B67D 7/00*** | (2010.01) |
| *B01F 23/237* | (2022.01) |
| *B01F 101/17* | (2022.01) |

(52) U.S. Cl.

CPC ..... *B01F 23/236* (2022.01); *B67D 3/0012* (2013.01); *B67D 7/005* (2013.01); *B67D 7/06* (2013.01); *B01F 23/237611* (2022.01); *B01F 2101/17* (2022.01)

(58) Field of Classification Search

CPC ..... B01F 23/236

See application file for complete search history.

(56) References Cited

U.S. PATENT DOCUMENTS 9,643,137 B2 * 5/2017 Casper ..... B01F 23/236

* cited by examiner

*Primary Examiner* — Robert A Hopkins

(74) *Attorney, Agent, or Firm* — Amundsen Davis, LLC; Joseph S. Heino; Erin E. Kaprelian

(57) ABSTRACT

The invention comprises a carrier used in an aeration assembly to assist a user in dispensing wine from a box through a spigot to flow into an aeration device and into a drinking vessel.

3 Claims, 2 Drawing Sheets

BOX WINE AERATION ACCESSORY

RELATED APPLICATION

This application claims the benefit of provisional application Ser. No. 62/656,310 filed 4 Jun. 2019.

BACKGROUND OF THE INVENTION

The popularity of wine as the alcoholic beverage of choice for American consumers has risen dramatically since the end of the National Prohibition Act in 1933. Indeed, wine consumption in the United States has risen from approximately 33 million gallons consumed in 1934 to 949 million gallons in 2016, the last year for which statistics are available. (Source: Wine Institute et al.) This increase in consumption has led to a corresponding increase in the varieties, price points, and vehicles available for wine consumers, including boxed wine.

Boxed wine has been widely available for decades as an inexpensive, lightweight, non-breakable, and ecologically friendly option to bottled wine. While boxed wine has previously had a reputation for poor quality, the rise in wine popularity has likewise elevated the offerings of boxed wines available commercially. In fact, now some vintners pride themselves on providing quality wine in the bag-in-box format.

The aforementioned increase in wine consumption has also led to a proliferation of wine accessories such as moderately priced crystal wine glasses, charms for attachment to wine class stems to prevent confusion among a plurality of wine drinkers, and wine bottle stoppers.

Among these accessories are wine aerators. Aeration has proven positive effects on the flavor of wine, permitting oxygenation to bring out a wine's flavor profile and evaporation to assist in removing less desirable compounds. Aeration is known to be particularly beneficial to improve younger wines that have not had sufficient time to soften naturally.

Allowing wine "to air" according to traditional methods may include pouring the vine into a wide-bottomed decanter, which enlarges the surface area exposed to the atmosphere. This allows the wine to accept oxygen and release unwanted compounds passively. Naturally, passive aeration takes time.

Aerators provide the advantages of lengthy decanting methods in a rapid fashion. With an aerator, a portion of wine is poured therethrough, actively infusing oxygen. This produces immediate and noticeable improvement in the character of the wine.

Prior art aerators primarily include hand-held devices. In operation, a user (a) places a glass on a stable surface, (b) picks up and holds an aerator over the glass in one hand, (c) with the other hand picks up and holds an open bottle of wine over the aerator, then (d) pours wine from the bottle through the aerator into the glass.

However, boxed wine is not designed to be picked up, but rather to rest on a surface such, as a table or countertop. Further, boxed wine is not dispensed from an open container, but is sealed by way of a manually activated ball valve forming a spigot.

Boxed wine is dispensed through the spigot, which is located near the base of the box. The spigot is actuated by a lever, twist release cap, push button, or the like. Regardless of the mode of operation, the spigot requires manual intervention to open. In other words, dispensing wine from a boxed wine container requires two hands: one to grip the glass and one to operate the spigot.

Interposing an aerator between the spigot and a glass thus requires three hands: one to grip the glass, one to operate the spigot, and one to hold the aerator therebetween. A two-handed operator attempting to aerate a boxed wine therefore encounters not only nuisance but usually mess and waste as well. Red wine spills in particular are notoriously difficult to clean.

In addition, no matter how a boxed wine operator dispenses wine through an aerator, when the glass is removed from, beneath the aerator, additional wine may drip from the aerator onto the counter or floor, or worse, one's clothing.

SUMMARY OF THE INVENTION

It the object of the invention to relieve the problems associated with the use of an aerator with boxed wines. Specifically, the present invention comprises an aerator hanging device that permits simple, single user operation of an aerator in combination with a boxed wine.

It is a further object of the invention to provide an aerator holder for use with a boxed wine that reduces nuisance, mess, and waste.

It is yet a further object of the invention to provide an aerator holder designed to mitigate dripping after use.

DESCRIPTION OF THE PREFERRED EMBODIMENT

Figure 1:
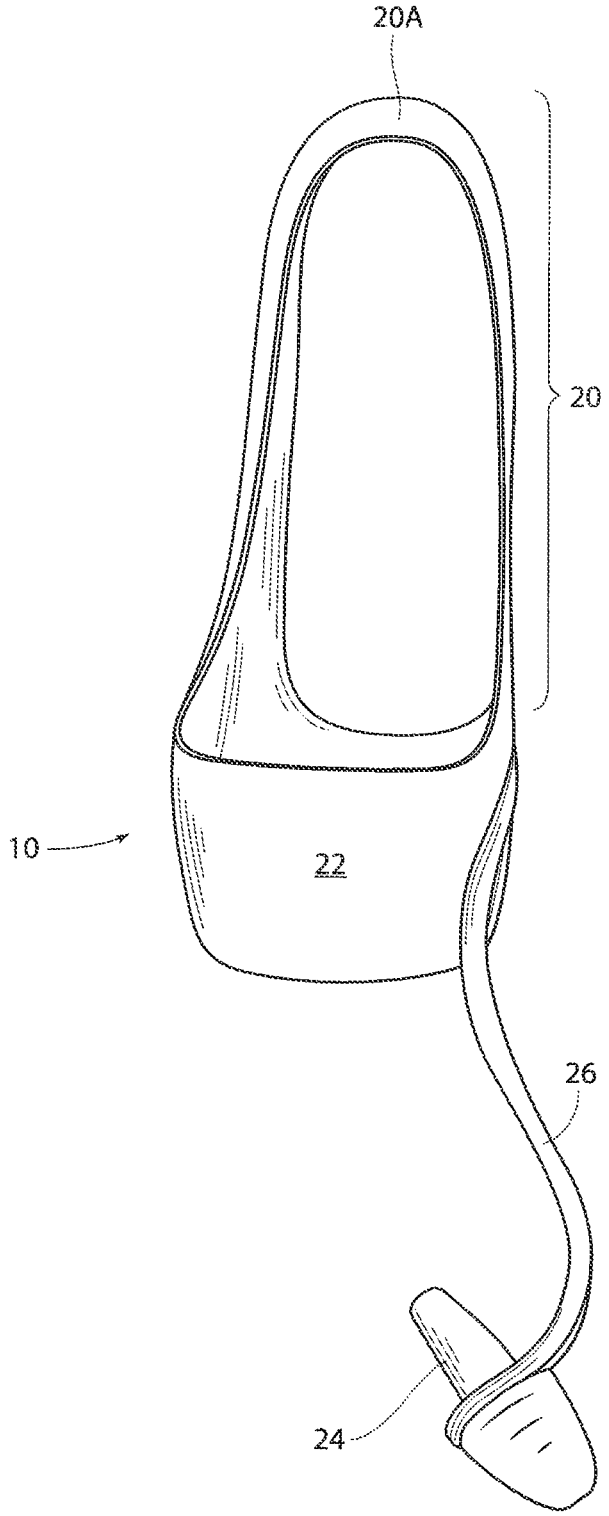
FIG. 1 is a perspective view of a first embodiment of the invention.

The invention comprises a carrier 10 used in an aeration assembly 12 to assist a user in dispensing wine from a box 14 through a spigot 16 to flow into an aeration device 18 and into a drinking vessel.

As seen in FIG. 1, carrier 10 has a handle portion 20 and a gripping portion 22. Handle portion 20 has a flattened surface 20A that progressively widens into gripping portion 22. FIG. 1 also illustrates a stopper insert 24, discussed further infra, which is preferably attached to carrier 10 by way of an attachment cord 26 or the like.

Figure 2:
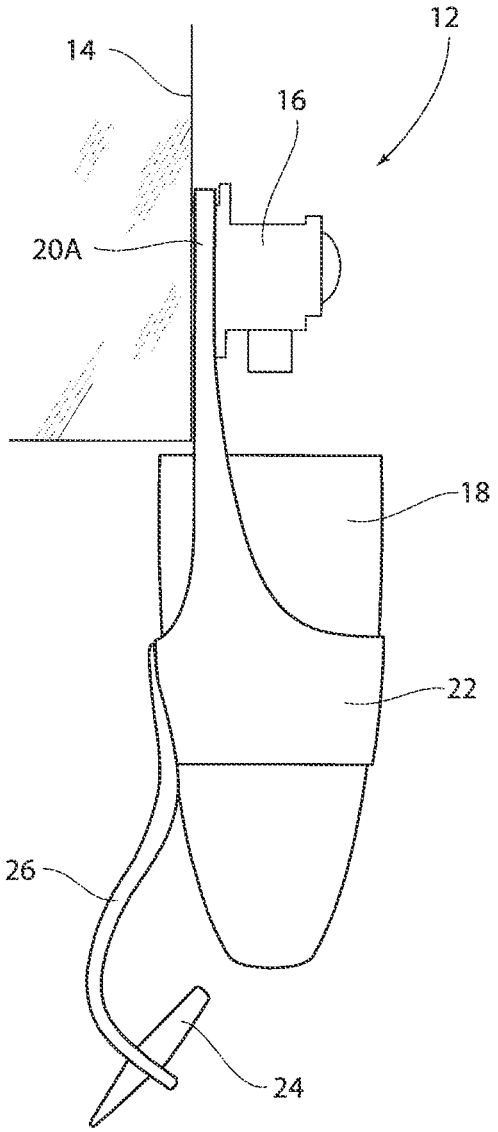
FIG. 2 is a side view of a variant of the embodiment of FIG. 1, shown in situ.
Figure 3:
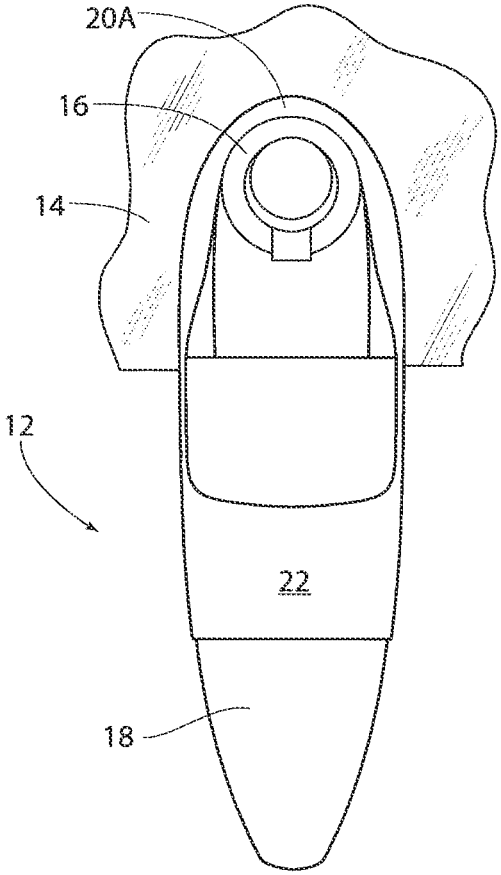
FIG. 3 is a front view of a variant of the embodiment shown in FIG. 1, again shown in situ.

Turning to FIG. 2, carrier 10 is shown as part of assembly 12. That is, carrier 10 in hung from spigot 16 extending from box 14. Flattened surface 20A lies flat against box 14. Gripping portion 22 is designed to grip the exterior surface of aeration device 18.

In a preferred embodiment, handle 20 has an overall length of 3.883 inches such that it extends approximately 2.28 inches below the spigot 16. Gripping portion 22 has an outer diameter of 2.541 inches to accommodate popular and commercially-available wine aerating devices. Other sizes and shapes should be understood as within the scope of the invention depending on the variety of spigot 16 being employed, the distance between spigot 16 and the bottom of box 14, and the configuration of device 18, among other design factors.

Handle 20 and gripping portion 22 are preferably made of a material selected for the desired stretch and gripping characteristics. Handle 20 and gripping portion 22 are shown as integral to one another, but may be assembled or attached to one another in any appropriate manner.

Referring now to stopper insert 24, it may extend from gripping portion 22 and provides the user with a means to mitigate the spillage incidental to wine aerators and box wines generally. Stopper 24 is designed to be inserted within the exit aperture of wine aerator 18. In a preferred embodiment, stopper 24 comprises an enclosed well for the purpose of containing any additional spilled wine.

In addition, it should be noted that while a first embodiment and variations of same are disclosed herein, other embodiments may employ a rope or chain or other appropriate hanging device.

A method of operation as generally discussed herein is also understood to form a part of the invention.

The present invention has been described in sufficient detail to allow a person of skill in the art to make and use the device. It should also be understood to include all variants and equivalents to the apparatus and method disclosed.

I claim:

1. An apparatus for use with a box of wine, said wine box comprising a spigot, and an aeration device comprising a body, the apparatus comprising:

a handle portion and a gripping portion wherein:

said handle portion has an upper region and a lower region wherein said upper region is adapted to hang from the spigot of the box of wine and said lower region is adapted to carry said gripping portion;

wherein the handle portion comprises a flattened surface that progressively widens from the upper region of the handle portion to the lower region of the handle portion; and said gripping portion is adapted to accept the body of the aeration device.

2. A method of using the apparatus of claim 1 comprising the steps of:

hanging the handle portion of the apparatus on said spigot;

inserting the body of the aeration device into the gripping portion of said apparatus;

holding a glass below said body of the aeration device; and opening said spigot to permit wine to flow through the body of the aeration device and into said glass.

3. The apparatus of claim 1 further comprising an exit aperture defined in the aeration device and an exit aperture stopper insert.

* * * * *